US012588710B2

(12) United States Patent
Nelson

(10) Patent No.: US 12,588,710 B2
(45) Date of Patent: Mar. 31, 2026

(54) POWER LEVEL INDICATION IN A DEVICE FOR AN ELECTRONIC AEROSOL PROVISION SYSTEM

(71) Applicant: Nicoventures Trading Limited, London (GB)

(72) Inventor: David Alan Nelson, London (GB)

(73) Assignee: NICOVENTURES TRADING LIMITED, London (GB)

( * ) Notice: Subject to any disclaimer, the term of this patent is extended or adjusted under 35 U.S.C. 154(b) by 573 days.

(21) Appl. No.: 17/783,737

(22) PCT Filed: Dec. 10, 2020

(86) PCT No.: PCT/GB2020/053168

§ 371 (c)(1),
(2) Date: Jun. 9, 2022

(87) PCT Pub. No.: WO2021/116687

PCT Pub. Date: Jun. 17, 2021

(65) Prior Publication Data

US 2023/0014618 A1 Jan. 19, 2023

(30) Foreign Application Priority Data

Dec. 10, 2019 (GB) ..... 1918091

(51) Int. Cl.
*A24F 40/50* (2020.01)
*A24F 40/10* (2020.01)

(52) U.S. Cl.
CPC ..... *A24F 40/50* (2020.01); *A24F 40/10* (2020.01)

(58) Field of Classification Search
CPC ..... A24F 40/50; A24F 40/10
See application file for complete search history.

(56) References Cited

U.S. PATENT DOCUMENTS

2011/0265806 A1 11/2011 Alarcon et al.
2014/0270727 A1 9/2014 Ampolini et al.
2014/0278250 A1 9/2014 Smith et al.
2015/0272223 A1 10/2015 Weigensberg et al.
(Continued)

FOREIGN PATENT DOCUMENTS

EP 3210481 A1 8/2017
WO WO 2014066730 A1 5/2014
WO WO2020225099 * 11/2020 ..... A24F 40/70

OTHER PUBLICATIONS

International Preliminary Report on Patentability, International Application No. PCT/GB2020/053168, mailing date Dec. 10, 2019, 12 pages.

(Continued)

*Primary Examiner* — Linda L Gray
(74) *Attorney, Agent, or Firm* — BURR & FORMAN

(57) ABSTRACT

A device for an electronic aerosol provision system that includes an indicator for showing power level. The device comprises: a battery for providing electrical power to an aerosol generating component in the system; an indicator light configured to emit a light signal for a signal period that indicates a level of electrical power available from the battery; and a controller configured to activate the indicator light to emit the light signal after detecting that a puff period on the system has been completed.

18 Claims, 5 Drawing Sheets

(56) References Cited

U.S. PATENT DOCUMENTS

2018/0020725 A1 1/2018 Alarcon

OTHER PUBLICATIONS

International Search Report and Written Opinion, Application No. PCT/GB2020/053168, mailing date Dec. 10, 2020, 14 pages.
UK Search Report, Application No. GB1918091.8, mailing date Jun. 8, 2020, 4 pgs.
Notification of Rejection (with translation) issued in Korean Application No. 10-2022-7023463 on Jan. 1, 2025, all enclosed pages cited.

* cited by examiner

POWER LEVEL INDICATION IN A DEVICE FOR AN ELECTRONIC AEROSOL PROVISION SYSTEM

PRIORITY CLAIM

The present application is a National Phase entry of PCT Application No. PCT/GB2020/053168, filed Dec. 10, 2020, which claims priority from Great Britain Application No. 1918091.8, filed Dec. 10, 2019, each of which is hereby fully incorporated herein by reference.

TECHNICAL FIELD

The present disclosure relates to a device for an electronic aerosol provision system that includes an indicator for showing power level, systems including such a device, and method for providing an indication of power level in such systems and devices.

BACKGROUND

Many electronic aerosol provision systems, such as e-cigarettes and other electronic nicotine delivery systems that deliver nicotine by vaporizing or heating a substrate material, are formed from two main components or sections, which may be termed a device and an article. The device is a control or power section or component, and may include a power source such as a battery, and a controller or control unit, comprising electronics configured to operate the system, such as circuitry and/or software. The article may be considered as a cartridge or cartomizer section, and includes a storage area for aerosolizable material, and often an aerosol generating component such as a heater configured to generate vapor for aerosol formation from the aerosolizable material. The aerosol generating component may alternatively be in the device. The article may be intended to be disposable when the aerosolizable material is exhausted so that it is replaceable with a new article for use in conjunction with the device, where the device is intended to operate over the lifetime of many articles. Alternatively, the article may include a smaller disposable component or consumable containing the aerosolizable material which can be replaced when exhausted, or the article may be refillable with new aerosolizable material. The article and the device may be separate elements that couple together to form the system, or the system may have a unitary construction containing all the parts of the article and the device.

In any of these arrangements, the power source is configured to provide electrical power, generally under the control of the control unit, to activate the aerosol generating component when aerosol generation is required by a user of the system. The power source may be rechargeable or replaceable battery, which will become exhausted over time. It is useful to provide the user with an indication of the status of the battery, such as whether or not it is exhausted or "flat", or how much power is remaining. Some systems and devices are provided with an indicator operable to provide a visual indication to the user of the power status of the battery. The indicator may comprise a light emitter visible on the outside of the device, and may also indicate other operating characteristics of the system to the user.

Arrangements for effective utilization of power level indicators are of interest.

SUMMARY

According to a first aspect of some embodiments described herein, there is provided a device for an electronic aerosol provision system comprising: a battery for providing electrical power to an aerosol generating component in the system; an indicator light configured to emit a light signal for a signal period that indicates a level of electrical power available from the battery; and a controller configured to activate the indicator light to emit the light signal after detecting that a puff period on the system has been completed.

According to a second aspect of some embodiments described herein, there is provided a method of operating an electronic aerosol provision system, comprising: determining a level of electrical power available from a battery that provided electrical power to an aerosol generating component in the system; detecting that a puff period on the system has been completed; and in response to the detection, activating an indicator light to emit a light signal that indicates the level of electrical power.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, an electronic aerosol provision system or a device therefor may be provided in accordance with approaches described herein which includes any one or more of the various features described below as appropriate.

BRIEF DESCRIPTION OF THE DRAWINGS

Various embodiments of the invention will now be described in detail by way of example only with reference to the following drawings in which.

DETAILED DESCRIPTION OF THE DRAWINGS

Figure 1:
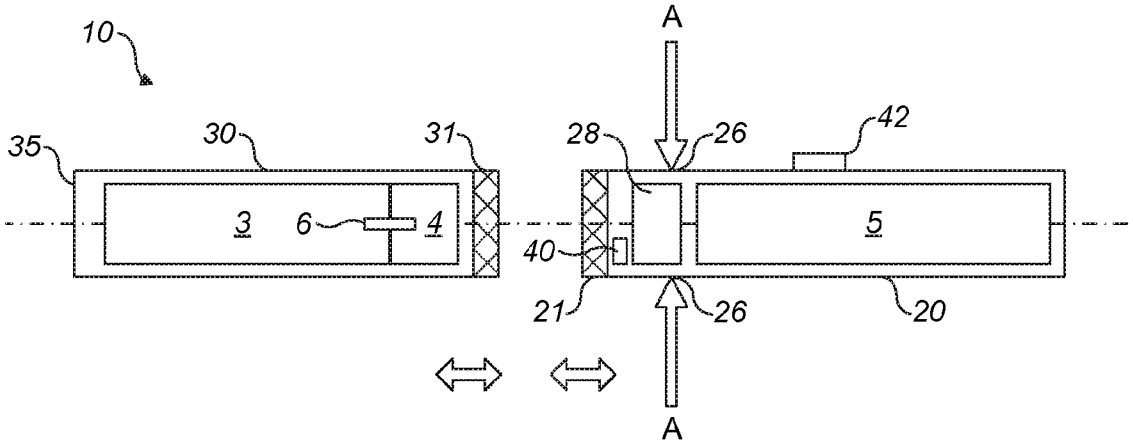
FIG. 1 shows a simplified schematic cross-section through an example electronic aerosol provision system in which embodiments of the present disclosure can be implemented.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapor provision systems, such as e-cigarettes. Throughout the following description the terms "e-cigarette" and "electronic cigarette" may sometimes be used; however, it will be appreciated these terms may be used interchangeably with aerosol (vapor) provision system or device. The systems are intended to generate an inhalable aerosol by vaporization of a substrate in the form of a liquid or gel which may or may not contain nicotine. Additionally, hybrid systems may comprise a liquid or gel substrate plus a solid substrate which is also heated. The solid substrate may be for example tobacco or other non-tobacco products, which may or may not contain nicotine. The term "aerosolizable material" as used herein is intended to refer to materials which can form an aerosol, either through the application of heat or some other means. The term "aerosol" may be used interchangeably with "vapor".

As used herein, the terms "system" and "delivery system" are intended to encompass systems that deliver a substance to a user, and include non-combustible aerosol provision systems that release compounds from an aerosolizable material without combusting the aerosolizable material, such as electronic cigarettes, tobacco heating products, and hybrid systems to generate aerosol using a combination of aerosolizable materials, and articles comprising aerosolizable material and configured to be used within one of these non-combustible aerosol provision systems. According to the present disclosure, a "non-combustible" aerosol provision system is one where a constituent aerosolizable material of the aerosol provision system (or component thereof) is not combusted or burned in order to facilitate delivery to a user. In some embodiments, the delivery system is a non-combustible aerosol provision system, such as a powered non-combustible aerosol provision system. In some embodiments, the non-combustible aerosol provision system is an electronic cigarette, also known as a vaping device or electronic nicotine delivery system (END), although it is noted that the presence of nicotine in the aerosolizable material is not a requirement. In some embodiments, the non-combustible aerosol provision system is a tobacco heating system, also known as a heat-not-burn system. In some embodiments, the non-combustible aerosol provision system is a hybrid system to generate aerosol using a combination of aerosolizable materials, one or a plurality of which may be heated. Each of the aerosolizable materials may be, for example, in the form of a solid, liquid or gel and may or may not contain nicotine. In some embodiments, the hybrid system comprises a liquid or gel aerosolizable material and a solid aerosolizable material. The solid aerosolizable material may comprise, for example, tobacco or a non-tobacco product.

Typically, the non-combustible aerosol provision system may comprise a non-combustible aerosol provision device and an article for use with the non-combustible aerosol provision device. However, it is envisaged that articles which themselves comprise a means for powering an aerosol generating component may themselves form the non-combustible aerosol provision system. In some embodiments, the non-combustible aerosol provision device may comprise a power source and a controller. The power source may, for example, be an electric power source. In some embodiments, the article for use with the non-combustible aerosol provision device may comprise an aerosolizable material, an aerosol generating component, an aerosol generating area, a mouthpiece, and/or an area for receiving aerosolizable material.

In some embodiments, the aerosol generating component is a heater capable of interacting with the aerosolizable material so as to release one or more volatiles from the aerosolizable material to form an aerosol. In some embodiments, the aerosol generating component is capable of generating an aerosol from the aerosolizable material without heating. For example, the aerosol generating component may be capable of generating an aerosol from the aerosolizable material without applying heat thereto, for example via one or more of vibrational, mechanical, pressurization or electrostatic means.

In some embodiments, the article for use with the non-combustible aerosol provision device may comprise aerosolizable material or an area for receiving aerosolizable material. In some embodiments, the article for use with the non-combustible aerosol provision device may comprise a mouthpiece. The area for receiving aerosolizable material may be a storage area for storing aerosolizable material. For example, the storage area may be a reservoir. In some embodiments, the area for receiving aerosolizable material may be separate from, or combined with, an aerosol generating area.

As used herein, the term "component" may be used to refer to a part, section, unit, module, assembly or similar of an electronic cigarette or similar device that incorporates several smaller parts or elements, possibly within an exterior housing or wall. An aerosol delivery system such as an electronic cigarette may be formed or built from one or more such components, such as an article and a device, and the components may be removably or separably connectable to one another, or may be permanently joined together during manufacture to define the whole system. The present disclosure is applicable to (but not limited to) systems comprising two components separably connectable to one another and configured, for example, as an article in the form of an aerosolizable material carrying component holding liquid or another aerosolizable material (alternatively referred to as a cartridge, cartomizer or consumable), and a device having a battery or other power source for providing electrical power to operate an aerosol generating component for creating vapor/aerosol from the aerosolizable material. A component may include more or fewer parts than those included in the examples.

In some examples, the present disclosure relates to aerosol provision systems and components thereof that utilize aerosolizable material in the form of a liquid or a gel which is held in a reservoir, tank, container or other receptacle comprised in the system, or absorbed onto a carrier substrate. An arrangement for delivering the material from the reservoir for the purpose of providing it to an aerosol generating component for vapor/aerosol generation is included. The terms "liquid", "gel", "fluid", "source liquid", "source gel", "source fluid" and the like may be used interchangeably with "aerosolizable substrate material" and "substrate material" to refer to aerosolizable substrate material that has a form capable of being stored and delivered in accordance with examples of the present disclosure.

FIG. 1 is a highly schematic diagram (not to scale) of a generic example aerosol/vapor provision system such as an e-cigarette 10, presented for the purpose of showing the relationship between the various parts of a typical system and explaining the general principles of operation. Note that the present disclosure is not limited to a system configured in this way, and features may be modified in accordance with the various alternatives and definitions described above and/or apparent to the skilled person. The e-cigarette 10 has a generally elongate shape in this example, extending along a longitudinal axis indicated by a dashed line, and comprises two main components, namely a device 20 (control or power component, section or unit), and an article 30 (cartridge assembly or section, sometimes referred to as a cartomizer or clearomizer) carrying aerosolizable material and operating as a vapor-generating component.

The article 30 includes a reservoir 3 containing a source liquid or other aerosolizable material comprising a formulation such as liquid or gel from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavorings. Nicotine-free source liquid may also be used, such as to deliver flavoring. A solid substrate (not illustrated), such as a portion of tobacco or other flavor element through which vapor generated from the liquid is passed, may also be included. The reservoir 3 has the form of a storage tank, being a container or receptacle in which source liquid can be stored such that the liquid is free to move and flow within the confines of the tank. For a consumable article, the reservoir 3 may be sealed after filling during manufacture so as to be disposable after the source liquid is consumed; otherwise, it may have an inlet port or other opening through which new source liquid can be added by the user. The article 30 also comprises an aerosol generating component 4, for example an electrically powered heating element or heater 4 located externally of the reservoir tank 3 for generating the aerosol by vaporization of the source liquid by heating. A liquid transfer or delivery arrangement (liquid transport element or more generally an aerosolizable material transfer component) such as a wick or other porous element 6 may be provided to deliver source liquid from the reservoir 3 to the heater 4. A wick 6 may have one or more parts located inside the reservoir 3, or otherwise be in fluid communication with the liquid in the reservoir 3, so as to be able to absorb source liquid and transfer it by wicking or capillary action to other parts of the wick 6 that are adjacent or in contact with the heater 4. This liquid is thereby heated and vaporized, to be replaced by new source liquid from the reservoir for transfer to the heater 4 by the wick 6. The wick may be thought of as a conduit between the reservoir 3 and the heater 4 that delivers or transfers liquid from the reservoir to the heater.

A heater and wick (or similar) combination is sometimes referred to as an atomizer or atomizer assembly, and the reservoir with its source liquid plus the atomizer may be collectively referred to as an aerosol source. Various designs are possible, in which the parts may be differently arranged compared with the highly schematic representation of FIG. 1. For example, the wick 6 may be an entirely separate element from the heater 4, or the heater 4 may be configured to be porous and able to perform at least part of the wicking function directly (a metallic mesh, for example). In an electrical or electronic device, the vapor generating element may be an electrical heating element that operates by ohmic/resistive (Joule) heating or by inductive heating. In general, therefore, an atomizer can be considered as one or more elements that implement the functionality of a vapor-generating or vaporizing element able to generate vapor from source liquid delivered to it, and a liquid transport or delivery element able to deliver or transport liquid from a reservoir or similar liquid store to the aerosol generating component by a wicking action/capillary force. An atomizer is typically housed in an article 30 of an aerosol generating system, as in FIG. 1, but in some examples, at least the aerosol generating component may be housed in the device 20. In some designs, liquid may be dispensed from a reservoir directly onto a vapor generator with no need for a distinct wicking or capillary element. Embodiments of the disclosure are applicable to all and any such configurations which are consistent with the examples and description herein.

Returning to FIG. 1, the article 30 also includes a mouthpiece or mouthpiece portion 35 having an opening or air outlet through which a user may inhale the aerosol generated by the atomizer 4.

The device 20 includes a cell or battery 5 (referred to herein after as a battery, and which may or may not be re-chargeable) to provide electrical power for electrical components of the e-cigarette 10, in particular to operate the heater 4 (or other aerosol generating component). Additionally, there is a controller 28 such as a printed circuit board and/or other electronics or circuitry for generally controlling the e-cigarette. The controller may include a processor programmed with software, which may be modifiable by a user of the system. The control electronics/circuitry 28 operates the heater 4 using power from the battery 5 when vapor is required. At this time, the user inhales on the system 10 via the mouthpiece 35, and air A enters through one or more air inlets 26 in the wall of the device 20 (air inlets may alternatively or additionally be located in the article 30). When the heating element 4 is operated, the heating element 4 vaporizes source liquid delivered from the reservoir 3 by the liquid delivery element 6 to generate the aerosol by entrainment of the vapor into the air flowing through the system, and this is then inhaled by the user through the opening in the mouthpiece 35. The aerosol is carried from the aerosol source to the mouthpiece 35 along one or more air channels (not shown) that connect the air inlets 26 to the aerosol source to the air outlet when a user inhales on the mouthpiece 35.

The device 20 and the article 30 are separate connectable parts detachable from one another by separation in a direction parallel to the longitudinal axis, as indicated by the solid arrows in FIG. 1. The components 20, 30 are joined together when the device 10 is in use by cooperating engagement elements 21, 31 (for example, a screw or bayonet fitting) which provide mechanical and in some cases electrical connectivity between the device 20 and the article 30. Electrical connectivity is required if the heater 4 operates by ohmic heating, so that current can be passed through the heater 4 when it is connected to the battery 5. In systems that use inductive heating, electrical connectivity can be omitted if no parts requiring electrical power are located in the article 30. An inductive work coil can be housed in the device 20 and supplied with power from the battery 5, and the article 30 and the device 20 shaped so that when they are connected, there is an appropriate exposure of the heater 4 to flux generated by the coil for the purpose of generating current flow in the material of the heater. Other electrically powered examples of aerosol generating components include a vibrating mesh that expels droplets of liquid, for example operating via the piezoelectric effect. The FIG. 1 design is merely an example arrangement, and the various parts and features may be differently distributed between the device 20 and the article 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted (the reservoir is empty or the battery is flat, for example), or be intended for multiple uses enabled by actions such as refilling the reservoir and recharging the battery. In other examples, the system 10 may be unitary, in that the parts of the device 20 and the article 30 are comprised in a single housing and cannot be separated. Embodiments and examples of the present disclosure are applicable to any of these configurations and other configurations of which the skilled person will be aware.

The act of inhaling on an electronic cigarette or other aerosol provision system in order to obtain a quantity or dose of aerosol for consumption by the user is often referred to as puffing, and a single inhalation act is termed a puff. A puff has a duration, which for convenience herein is termed the "puff period". Typical puff durations are off the order of a few seconds, and varying from user to user and for an individual user at different times.

In order to operate the aerosol provision system to generate aerosol during a puff, the system will include a mechanism or arrangement operable to activate the aerosol generating component when aerosol is required. For example, the activation may be of a heater, achieved by supplying electrical power from the battery to the heater. The provision of electrical power (to a heater or other electrically-operated aerosol generating component) may be under the control of the controller in the device, on receipt of signals indicating that a puff is starting and ending.

Two examples of such arrangements are an air-flow sensor and a user-operated switch. Referring to FIG. 1, an air-flow sensor 40 may be located inside the device 20 or alternatively inside the article 30. The air-flow sensor is operable to detect the flow of air through the system, from the air inlets 26 to the mouthpiece 35, when the user inhales to achieve a puff. When the air flow sensor 40 detects air-flow (which may require a level above a threshold corresponding to a typical user inhalation force or pressure, for example), a start signal is communicated to the controller 28, and in response, the controller 28 activates the heater 4 by providing it with electrical power from the battery 5, and aerosol is delivered. When the user stops inhaling, the air flow sensor 40 recognises the cessation of air flow, and a corresponding stop signal is communicated to the controller 28, whereupon electrical power supply to the heater 6 is stopped, and aerosol delivery ceases. The time between the start signal and the stop signal can be defined as the puff period, since it broadly corresponds to the time for which the user is inhaling on the system and able to obtain aerosol. Accordingly, an air flow sensor used in this manner is sometimes referred to as a puff detector.

Alternatively, the system may comprise a user-operated switch, or more generally a user actuable control. The control may have the form of a button 42 on the exterior of the housing of the device, as shown in FIG. 1. A button may be mechanical button, which is recessed, flush or protruding, or a touch-sensitive button. Other formats of control may be used, such as a switch with two or more positions, or a slider, which might be a mechanical slider or a touch-sensitive surface, or other formats which will be apparent to the skilled person. When the user desires a puff, the mouthpiece 35 is placed in the mouth for inhalation of air through the system as before, and the user operates the control using the relevant actuation. In response to the actuation, power is provided from the battery 5 to the heater 6, typically under control of the controller 28, in order to activate the heater and initiated aerosol generation. The user inhales the aerosol (takes a puff) until the desired quantity has been consumed. The user then operates the control 42 further in order to turn of the activation of the heater 6, by which the supply of power is halted. The operation of the control 42 may take any convenient form. For example, the control 42 may require to be activated for the duration of the puff, and when the user ceases actuation, the heater is turning off. In the case of a button, the user maintains pushing pressure on the button for the desired puff duration. In another example, the initial actuation of the control 42 may start the heater activation, and a subsequent actuation turns the heater off at the end of the puff in either case, the time between the heater being turned on (activated) and turned off (deactivated) can be defined as the puff period, broadly corresponding to the time for which the user is inhaling on the system and able to obtain aerosol.

Note that a user actuable control may be configured to enable alternative or additional functions of the system, beside heater activation for a puff. Also, a system may include both an air-flow sensor and one or more user actuable controls, where the air-flow sensor is configured for activation of the heater in response to inhalation, and the user actuable control or controls is configured for one or more other functions.

Aerosol provision systems that incorporate a battery may include a means to indicate to the user the power level or power status of the battery, in other words, how much power is available for future use of the system, or if there is power available for future use of the system. One approach for achieving a battery power level, or battery life, indication is to include an indicator light in the system, which is located so as to be visible to the user on an exterior surface of the system, conveniently but not necessarily on a surface of the device. The indicator light is illuminated to convey various operational characteristics of the system to the user, where different colors of light and/or different patterns or sequences of illumination (flashing or fading, for example) are used to indicate different characteristics. For example, one or more indicator lights may show a user when the heater is activated, or when the aerosolizable material is exhausted, or when the device is connected to an external power source for the purpose of charging the battery, and the charging is ongoing or complete. For the current disclosure, indication of the battery power level is of interest. This might be conveyed by illuminating the indicator light with different colors of light. For example, if the battery has a large proportion of its maximum possible charge available, such as at least 20%, or some other threshold amount, a first color may be shown, such as green. When the charge has decreased to a level where the battery is likely to run out (become flat) in the near future, such as less than 20% of the maximum, a second color of light might be shown, such as orange, yellow or amber. When the charge is nearly exhausted and the battery needs to be replaced or recharged immediately or nearly immediately to enable future use of the system, such as less than 5% of the maximum, or less than 2% of the maximum, a third color of light might be shown, such as red. Alternatively, two colors only might be used, such as green to indicate charge above a threshold such as 20% or 10% or 5%, and red to indicate charge below the threshold, thereby providing a prompt to the user to recharge or replace the battery. Colored light signals might be replaced with different light patterns in an alternative arrangement, such as a continuous illumination of the indicator light for a high or usable charge level and a flashing or pulsing illumination for a low charge level. In general, the illumination of the indicator light to indicate a level of electrical power or charge in the battery will be referred to herein as the emission of a light signal.

The indicator light will itself be operated by the supply of power from the battery, under the control of the controller which determines, according to its programming and in response to information received via circuitry from other components in the system, which light signal or signals should be emitted at any given time. While it is possible to emit the light signal indicating battery status at all times, so the user can always instantly determine the battery charge level, this will consume power from the battery that might more usefully be applied to other functions, in particular aerosol provision. Accordingly, it may be preferred to illuminate the indicator light with a battery charge level light signal on a non-continuous basis, for example in response to a particular event. It is known, for example, in the case of a system with a user actuable control such as a button, to present the battery charge level light signal in response to a particular actuation, such as a button press and immediate release (as compared to a press-and-hold actuation to activate the heater, for example).

Figure 2:
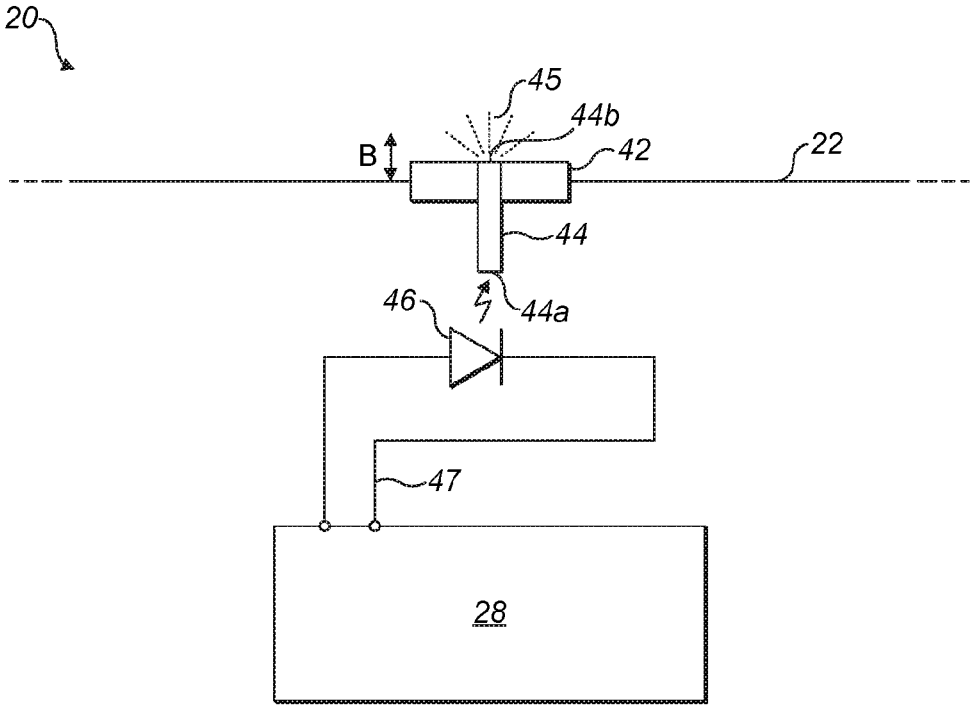
FIG. 2 shows a simplified schematic representation of a first example of an indicator light that may be used to implement embodiments of the present disclosure.

FIG. 2 shows a schematic representation of part of an example device for an aerosol provision system that incorporates an indicator light. The device 20 has an outer wall 22 that defines a housing inside which the various parts of the device are located, only some of which are shown in FIG. 2. A user actuable control in the form of a push-button 42 having an inward and outward actuation B is mounted on the wall 22 so as be accessible from the exterior of the device 20. The control 42 has an indicator light incorporated within it, which in this example comprises a light pipe 44 and a light emitting diode (LED) or light emitting diode unit 46. The light pipe 44 is mounted in the material of the button 42 and comprises a light-carrying element (such as an optical waveguide or optical fiber) mounted such that light propagating along it is emitted from an output end 44*b* (light emitter) of the light pipe 44 which lies in the plane of the button surface. The output end can be considered as the light emitting part or light emitter of the indicator light, since this is the part which delivers the light signals in a form visible to the user. The LED 46 is located inside the device 20, and positioned such that light it generates is collected by an input end 44*a* of the light pipe 44 so that the light can propagate to the output end 44*b*. In this way, a light signal 45 generated by the LED 46 is delivered externally of the device 20 where it can be perceived by the user.

The LED 46 is under the control of the device's controller 28, and receives appropriate driver signals from the controller 28 via control lines 47 in order to generate a required light signal. The LED receives power from the battery (not shown in FIG. 2), either directly or via the controller 28. The button 42 is also connected to the controller 28 (connection not shown) so that the controller 28 can receive information regarding the actuation state of the button 42 and use this to generate and send control signals to other components of the aerosol provision system, such as the battery and aerosol generating element in order to activate aerosol generation. Similarly, the controller may be connected to, for the purpose of sending and receiving other signals and information, other components of the system (not shown).

FIG. 2 shows the LED 42 proximate to the button 42, but this is not necessary. The light pipe 44 can be shaped and configured to carry light along any path from the LED, which can be located wherever is most convenient inside the device 20, to any desired position for the indicator light on the exterior of the device 20. A flexible optical fiber is particularly well-suited for such an arrangement. Also, the light pipe 44 need not have its output end 44*b* located within the boundary of the button 42.

Figure 3:
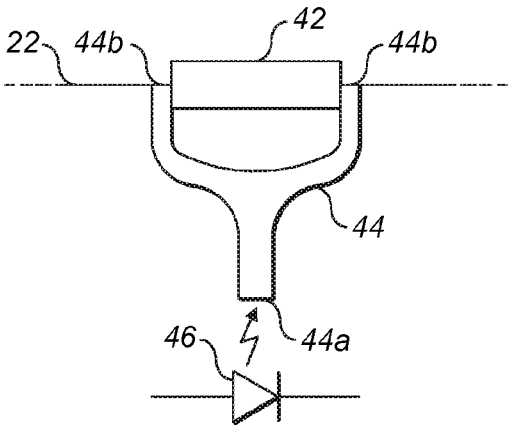
FIG. 3 shows a simplified schematic representation of a second example of an indicator light that may be used to implement embodiments of the present disclosure.

FIG. 3 shows a schematic representation of a further example of an indicator light in a device 20. The device 20 again includes a user actuable control 42, which may or may not be a push button, but in this case, the light pipe has a shaped output end 44*b* that is configured to surround the control 42, thereby providing a light emitter that gives an illuminated boundary for the control 42 when light is emitted.

Figure 4:
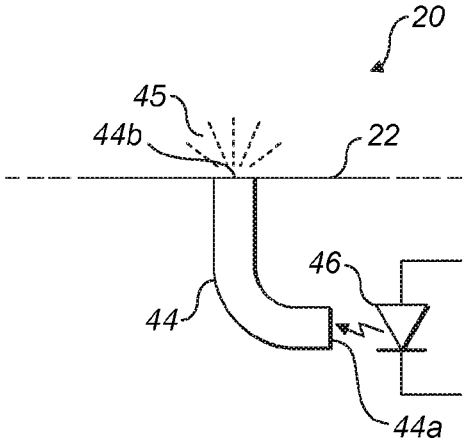
FIG. 4 shows simplified representation of a third example of an indicator light that may be used to implement embodiments of the present disclosure.

FIG. 4 shows a schematic representation of a further example of an indicator light in a device 20. In this example, the indicator light is not associated with any user actuable control, so the system may include an air flow sensor for puff detection activation of the aerosol generating element, or may have one or more user controls located elsewhere on its surface, remote from the indicator light. Accordingly, the light pipe 44, which in this case has a curved or bent shape within the device 20, and is again arranged to collect light generated from the LED 46 inside the device 20 via its input end 44*a*, has an output end 44*b* set directly into the wall 22 of the device 20 to emit light externally of the device 20. In such an arrangement, the light emitter defined by the output end 44*b* may have any desired shape in the plane on the wall 22, for example to give a indicator light with a spot shape, a circular shape or a line shape. A further alternative is an indicator light with a ring shaped light emitter that is disposed around the perimeter or circumference of the device wall 22. The ring may be continuous, or made up of intermittent points or lines. This may be useful for systems which have do not have a user actuable control for heater activation, and rely instead on puff detection. In such a system, there may be no particular orientation of the system in use, which would otherwise be defined by the position of a button accessed by the user during use. A ring-shaped indicator light will be potentially visible regardless of the orientation of the system.

While a light pipe is useful in giving flexibility for the relative positions of the external light output and the LED, and for the shape of the indicator light, it may be omitted. The LED may be encapsulated, for example in a plastic dome or other transparent or translucent shroud, and the encapsulation element used directly as the external output surface for the indicator light, thereby acting as the light emitter. A still further alternative arrangement may be employed in systems which have a reservoir for the aerosolizable material which is defined by a transparent outer wall so that the user can directly observe a level of remaining liquid or gel material. The indicator light may be positioned so as to emit the light signals through the reservoir wall into the reservoir interior. The light will scatter off the aerosolizable material and illuminate the reservoir interior, so the light signal is observable by the user externally to the reservoir. Additionally or alternatively, the transparent reservoir wall may act as a light pipe if appropriately shaped and disposed with regard to the LED.

The indicator light may comprise a single LED (or alternative light source, such as a diode laser), for example if there is no requirement for different colors of light so that instead patterns or sequences of light emission are used to define different light signals. Alternatively, an LED unit or LED device may be used, which comprises two or more elements each being an individual LED. The LED elements are packaged together to form a single unit able to emit light in a required direction. If the elements are configured to emit different colors of light, for example a red LED, a blue LED and a green LED, they can be operated alone or in combination in order to provide virtually any color of light. In this way, the light signals from the indicator light can be distinguished by being differently colored. Alternatively or additionally, multiple LED elements can be used to offer a wider or greater range of output brightnesses, according to the number of elements operated together. In the Figures herein, any depicted LED 46 (as in FIGS. 2, 3 and 4, for example) may be a single LED or an LED unit comprising two or more individual elements. Similarly, the terms LED and LED unit or LED device are used herein interchangeably to indicate a light emitting arrangement of one or more diodes.

As note the LED operates under the control of the controller, which provides appropriate drive signals to the LED to generate the required light signals at any given time. Accordingly, the LED may include a LED driver or driver unit configured to format the drive signals. Any approach to driving the LED may be used, for example constant current driving or constant voltage driving, as will be understood by the skilled person. Usefully in the context of aerosol provision systems, which are dependent on a self-contained battery for power so that efficient power consumption is desirable to maximize operational lifetime, the LED can be driven using pulse width modulation (PWM). This is a well-known LED driving technique in which the drive signals are configured to turn the LED rapidly on and off. For constant voltage, the LED is hence driven with a train of voltage pulses of constant amplitude. If the pulse rate (frequency) is high enough, where typically 200 Hz is used, the switching is imperceptible to the human eye and the LED appears to be emitting light continuously. The switching is useful in that the LED is on for only some of the time, so that less power from the battery is required to achieve illumination. Battery life is thereby conserved. Furthermore, switching enables an LED to be driven at a current and/or voltage which exceeds its operating specification (known as "overdriving"), so that a higher brightness level can be generated during the times that the LED is on.

The apparent brightness of a PWM-driven LED, that is the level of brightness perceived by a user, determined as an average of the actual brightness during the "on" periods and the zero brightness during the "off" periods, can be adjusted by changing the mark-to-space ratio of the PWM. That is, the proportion of "on" time compared to "off" time is changed, while the amplitude of the driving pulses stays constant. To make the LED's output dimmer, the length of the "on" pulses is shortened and/or the length of the "off" periods is increased, and to make the output brighter, the length of the "on" pulses is increased and/or the length of the "off" periods is decreased. This will be understood by the skilled person.

Alternatively, brightness can be adjusted by using the technique of constant current reduction, in which the amount of current provided to drive an LED is altered to produce a proportional change in the output brightness.

Examples in the present disclosure include the use of LED brightness adjustment, and this may be achieved using either of these techniques.

Herein, unless otherwise apparent from the context, brightness is used in the sense of the level of brightness which is perceivable by the user observing the LED, rather than the brightness during the "on" parts of a PWM driving sequence (which will be the same regardless of the perceived brightness), or the specified maximum brightness for the LED, which as noted can be exceeded when PWM is used.

In embodiments of the present disclosure, the indicator light of the aerosol provision system is driven so as to be enabled to emit light signals that indicate a level of electrical power which is available from the battery. The light emitting part of the indicator light is necessarily located on the outer surface of the system in order to be viewable by the user. However, the nature of some aerosol provision systems, such as electronic cigarettes, is that they are hand-held devices of relatively small size. In use, the light emitter may be wholly or partially obscured by the hand of the user as the system is held and operated. Also, when the user is inhaling through the mouthpiece of the system, the light emitter may be removed from the user's line of sight. Furthermore, while it is useful to convey the battery power level to the user in order that future use of the system can be planned and enabled, the excessive emission of battery-life indicating light signals will in itself use power and hence reduce the battery life.

Accordingly, it is proposed according to present embodiments to deliver a light signal indicating the current battery power level automatically after each puff. This limits regular communication to the user of the power status of the battery to periods of active use of the system, so that battery power needed to drive the indicator light is conserved. Automatic triggering of the light signal, as opposed to emission in response to a user request, provides effective real-time updates regarding the battery power level, so the user is well-informed and able to take appropriate action to maintain an operable battery, such as by recharging or replacement, and is less likely to be surprised by a flat or near-flat battery.

It is proposed that the automatic generation and emission of an indication of the battery power level, in the form of a light signal, is enabled by noting the end of a puff period on the aerosol provision system, and using this as a trigger to generate the light signal appropriate for the current battery status. The controller is configured to detect that a puff has been finished (the puff period is completed), and in response, activate the indicator light for emission of the light signal. As noted above, the light signal may be of a particular color or pulse pattern corresponding to the current level of charge in the battery.

Figure 5:
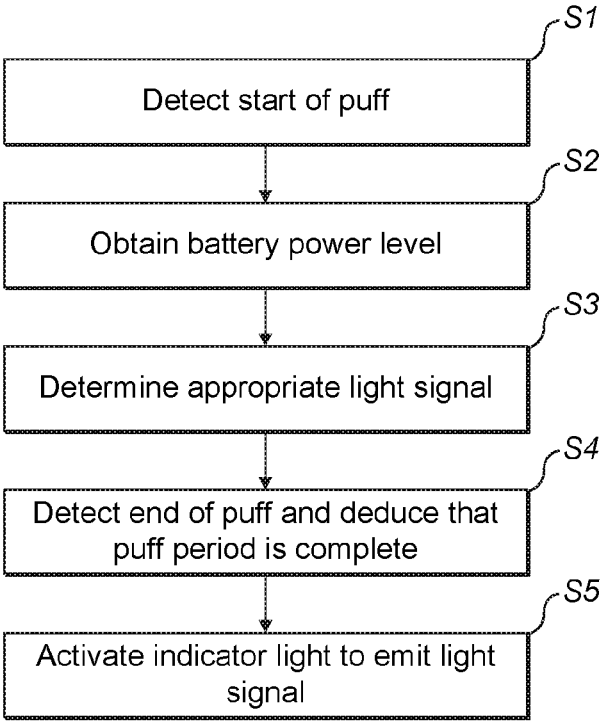
FIG. 5 shows a flow chart of a first example method for delivering a battery power level indicator light signal according to embodiments of the present disclosure.

FIG. 5 shows a flow chart of steps in a first example method for emitting a battery power level indicator light signal in an electrical aerosol provision system. In a first step S1, the controller determines that a puff is being initiated, so that the start of the puff is detected. At discussed above, this may be by detecting an airflow through the system when a user inhales, by use of an air flow detector, or by detecting the user actuation of a control configured to activate the aerosol generating element (such as a heater). During the puff period, that is, while the aerosol is being generated for inhalation, in step S2 the controller obtains a measurement indicating the current power level in the battery. This can be implemented in any known manner, since determining battery charge levels in a range of electrical devices is a standard technique. In step S3, the controller determines what the appropriate light signal will be to indicate the current power level to the user. For example, the power level measurement may be compared to one or more thresholds that divide the full range of possible charge levels into categories such as "high power", "intermediate power" and "low power". The current power level from step S2 can hence be allocated one of the categories, each of which has a corresponding light signal. The controller is then able to provide the appropriate drive signals to generate the correct light signal; these might be retrieved from memory within the controller or elsewhere in the system via a look-up table, for example. The memory can also store the threshold or boundary values that define the various charge level categories. In step S4, the controller detects the end of the puff, such as by noting the cessation of air flow through the system as detected by the air flow sensor, or by noting the cessation of actuation (or a terminating actuation) of the user control. In response the controller deduces that the puff has terminated; in other words, completion of the puff period is detected. In step S5, the controller activates the indicator light to emit the appropriate light signal as determined in step S3.

Figure 6:
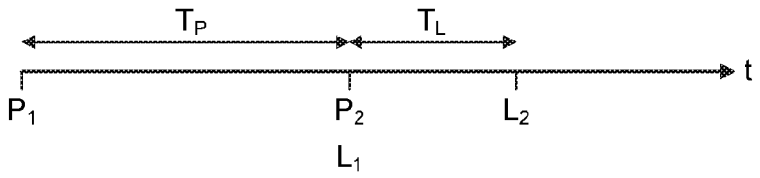
FIG. 6 shows a first example time line describing the emission of a battery power level indicator light signal according to embodiments of the present disclosure.

FIG. 6 shows a time line of the process of FIG. 5. At a time P1, the puff starts, as detected by the controller and the puff period Tp commences. At a later time P2, the end of the puff is detected, so the puff period Tp is determined as being complete. This triggers the activation of the indicator light to emit the appropriate light signal, reflecting the current charge or power status of the battery. The light signal is emitted for a time period starting at L1 and running to L2, to give a duration of TL for the light signal, which may be termed the signal period.

In this way, the user is automatically provided with an indication of the battery status, at a time when the user is able to observe the indicator light, that is, after a puff has been taken so that the system is not in the user's mouth, but is likely actively being held in proximity to the user so that the indicator light is in a potentially visible location.

As represented in FIG. 6, the light signal is emitted immediately or near immediately at the completion of the puff period. In other words, L1 is approximately equal to P2; L1 coincides with or falls just slightly later than P2.

However, a modification is proposed in a further embodiment. A time delay is introduced between the completion of the puff period and the activation of the indicator light for emission of the light signal. In other words, a pause is implement between the puff and the light signal. This is useful in further conserving battery power, since it delays the commencement of the light signal to a time at which the user is more likely to be able to observe the indicator light. The pause allows time for the user to remove the system from their mouth and locate the system somewhere in their field of vision, before the light signal is emitted. Hence, there is no emission during a time period when it is highly unlikely that the user will be able to observe the indicator light, since any such emission would likely be a waste of the battery power.

Figure 7:
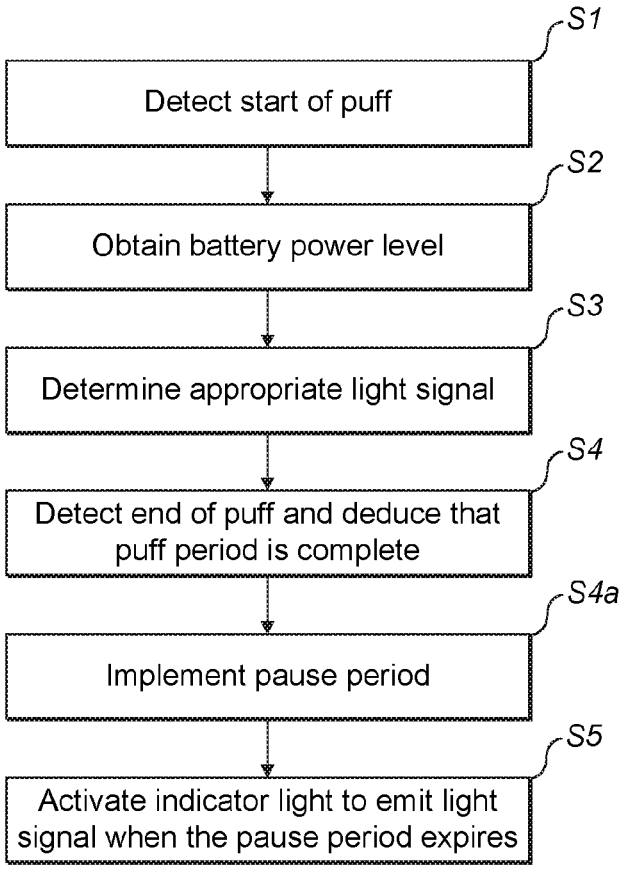
FIG. 7 shows a flow chart of a second example method for delivering a battery power level indicator light signal according to embodiments of the present disclosure.

FIG. 7 shows a flow chart of steps in a second example method for emitting a battery power level indicator light signal in an electrical aerosol provision system. The steps S1-S5 are the same as the steps S1-S5 in the example of FIG. 5 so will not be explained further here. However, the method includes an additional step S4*a* that is carried out between detecting the end of the puff and deducing completion of the puff period in step S4, and activating the indicator light in step S5. In step S4*a*, a pause period is implemented. When the end of the puff period has been detected in step S4, the pause period is started as step S4*a*. Then, when the pause period has expired, the light signal is emitted in step S5.

Figure 8:
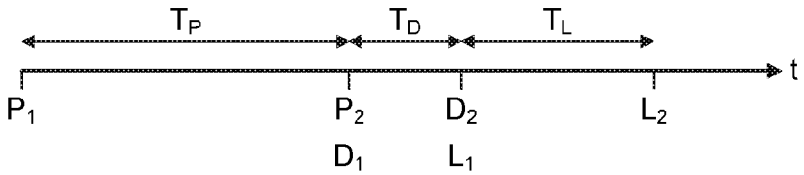
FIG. 8 shows a second example time line describing the emission of a battery power level indicator light signal according to embodiments of the present disclosure.

FIG. 8 shows a time line of the process of FIG. 7. As in the FIG. 6 example, the light signal is emitted for a signal period TL after the end of the puff period TP. However, a delay or pause period of duration TD is inserted between the puff period and the light signal emission. Hence, when the puff period ends at time P2, the pause period is started, with a start time D1. When the predetermined duration TD of the pause period is expired, at time D2, the indicator light is activated at time L1, to emit the light signal for a duration TL to a time L2. The end of the puff period at P2 coincides with the start of the pause period at D1, and the end of the pause period coincides with the start of the light signal emission period at L1.

The pause period may have a duration in the range of 0.3 seconds to 0.7 seconds, although longer or shorter pauses might be considered useful, such as in the range of 0.2 seconds to 0.8, 0.9 or 1.0 seconds. Pauses on this timescale give a reasonable amount of time for the user to move the aerosol provision system from their mouth to a typically holding position in which the indicator light can be seen. Shorter pause times may cause the light signal to commence before the indicator light is in view, which may be considered to waste a small amount of battery power. Longer pause times may cause the light signal to commence after the indicator is being observed by the user, which may cause the user to incorrectly conclude that the system is faulty. It has been found that a pause period of about 0.5 seconds is an appropriate delay for many users, with a pause period in the range of 0.4 seconds to 0.6 seconds encompassing a greater proportion of users, and 0.3 seconds to 0.7 seconds being largely inclusive for the expected behavior of most users.

If a pause is included in the time sequence for puffing and light emission, as in the FIG. 8 example, there is more scope for the timing of the steps of obtaining the battery power level and determining the appropriate corresponding light signal (steps S2 and S3 in FIGS. 5 and 7). There is no need for these steps to both be completed at completion of the puff period, because the light signal is not emitted straight away.

Figure 9:
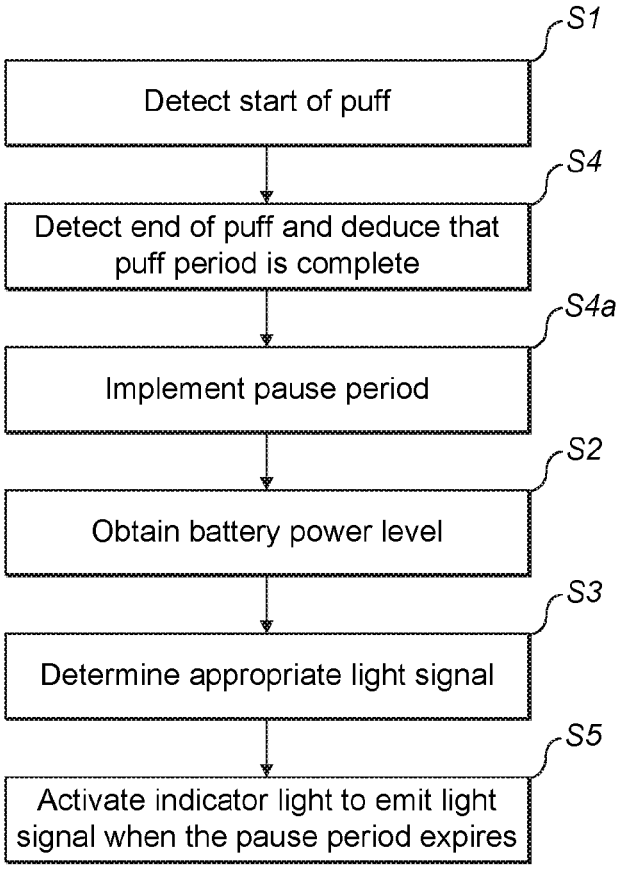
FIG. 9 shows a flow chart of a third example method for delivering a battery power level indicator light signal according to embodiments of the present disclosure.

FIG. 9 shows a flow chart of steps in a third example method for emitting a battery power level indicator light signal in an electrical aerosol provision system. The steps S1-S5 are the same as the correspondingly number steps in the FIG. 7 example, but are carried out in a different order. In particular, step S2, in which the current battery power level is obtained, and step S3, in which the appropriate light signal for the obtained battery power level is determined, are performed after the puff period is complete. In other words, they are carried out during the pause period, rather than during the puff period. Then, when the pause period expires, the required correct light signal is known, and the controller is able to activate the indicator light according in step S5.

A further modification is to carry out step S2, in which the battery power level is obtained, during the puff period, in other words between step S1 and step S4, and carry out step S3, in which the appropriate light signal is determined, during the pause period, in other words between step S4*a* and step S5.

In summary, there may or may not be a pause period placed between the puff period and the emission of the light signal, but in general the light signal is emitted after the puff period is complete, following detection of the end of the puff period. The light signal may be emitted immediately or near immediately as the puff period ends, or following a delay or pause.

The duration of the light signal (signal period TL in FIGS. 6 and 8) can be chosen so as to provide a user with a convenient length of viewing time (so that it is not too short and ceases before the user can properly see and appreciate the light signal) while also not using more battery power than is needed (so that the signal is not excessively longer than a time in which the user is able to properly see and appreciate the light signal). An overall duration of about 1.5 seconds has been found to be adequate. However, longer or shorter durations may be utilized in order to cover a wider or different variety of user behaviors and system types. For example, in a system in which the indicator light emitter is unusually placed or is likely to be covered by the user during a puff, a longer duration may be desirable in order to give the user more time to conveniently view the indicator light while it is illuminated. A longer pause period may also be useful in these circumstances. Overall, a light signal emission duration in the range of 1 second to 5 seconds is contemplated. A smaller range such as 1 second to 4 seconds, or 1 second to 3 seconds or 1 second to 2 seconds, may be chosen if preferred, when balancing the benefit of less power consumption against accommodating a wider variety of user behaviors.

In other embodiments in which a pause period is included, the total duration of the pause period plus the light signal emission period (signal period) can be configured to be in the same ranges as set out above. As a particular example, the time from the end of the puff period to the end of the emission of the light signal may be about 2 seconds, or more generally in a range of 1 second to 5 seconds, or 1 second to 4 seconds, or 1 second to 3 seconds, or 1 second to 2 seconds. In the example of 2 seconds, the pause period may have a duration of about 0.5 seconds, and the light signal emission time may be about 1.5 seconds.

The light signal may be implemented as a simple on-off light emission, or more complex illumination patterns may be adopted.

Figure 10:
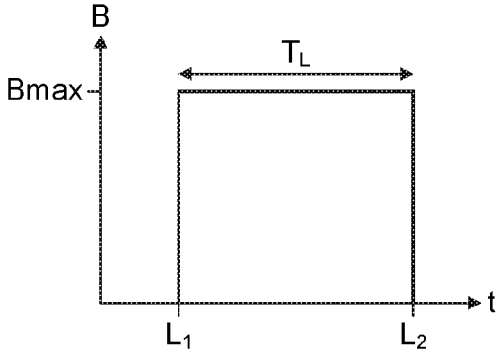
FIGS. 10 to 13 shows graphs of example brightness profiles suitable for battery power level indicator light signals provided in accordance with embodiments of the present disclosure.

FIG. 10 shows a graph of a first example of a light signal, represented as a plot of brightness B against time t. Recall that brightness is the perceived brightness (or intensity) for the user (rather than an actual brightness during the "on" pulses of PWM operation, for example). The indicator light is switched on and activated directly to a maximum brightness Bmax (where maximum brightness is the maximum for this particular light signal, rather than a maximum brightness available from the LED, although these may be the same) at the light signal start time L1, and maintained at Bmax for the light signal duration TL, and then deactivated or switched off at time L2, the end of the duration TL. This provides a simple approach to achieving the light signal, but modifications can produce a similar effect for a lesser level of power consumption. The same light signal duration can be utilized, but with the maximum brightness for the light signal displayed for only a portion of that duration.

Figure 11:
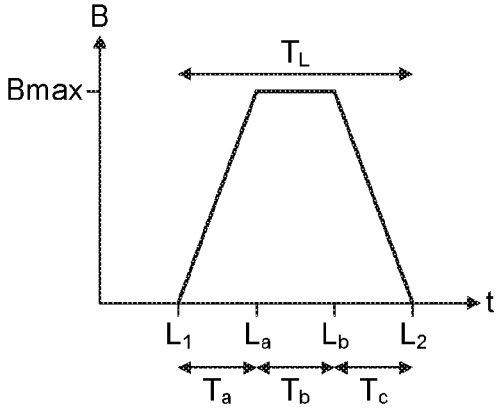

FIG. 11 shows a graph of a second example of a light signal. As in the FIG. 10 example, the indicator light is activated at start time L1, kept on for a duration TL and deactivated at end time L2. However, the light signal is comprised of three parts, each covering a portion of the duration TL. At time L1 the light indicator is activated and enters a first period of activation which lasts from L1 to a later time La. This is a ramp-up period, in which the brightness of the LED is gradually increased, in a linear manner, from zero to the maximum brightness Bmax for this light signal, which is reached at time La. The ramp-up period has a duration Ta. When Bmax is reached at time La, this level of brightness is maintained constant for a time period Tb, lasting until a time Lb. This is a constant brightness period of duration Tb. Finally, the light signal has a ramp-down period, starting at time Lb and lasting until time L2, the end point of the light signal. During the ramp-down period, which has a duration Tc, the brightness of the LED is gradually decreased, in a linear manner, from Bmax to zero. The total light signal duration TL therefore comprises Ta+Tb+Tc, and comprises a period of increasing brightness, a period of constant brightness which is the maximum brightness for the light signal in question, and a period of decreasing brightness.

Any relative durations may be chosen for the ramp-up period, the constant brightness period and the ramp-down period. In one example, each of the ramp-up period, the constant brightness period and the ramp-down period each have substantially the same duration. Possibly, each of the ramp-up period, the constant brightness period and the ramp-down period has a duration in the range of 0.3 seconds to 1.5 seconds, where the durations may or may not be the same. For example, one or more of the periods may have a duration of about 0.5 seconds. More particularly, each of the periods may have the same duration of about 0.5 seconds. If combined with a pause period also of about 0.5 seconds, the length of time from puff completion to end of light signal will be about 2 seconds. This gives a good balance between enabling effective user perception of the light signal and conserving battery power. The disclosure is not limited in this regard, however, and other time periods may be used, such as in the various example ranges presented herein.

Other shapes of light signal may also be used that offer a particular overall duration while saving power consumption by including a period of maximum brightness that is shorter than the overall length of the light signal emission time. The maximum brightness is the maximum selected for any particular light signal, rather than an actual maximum brightness achievable from the LED, such as the brightness indicated in the LED's technical specification or a higher brightness that may be achievable by overdriving the LED.

Figure 12:
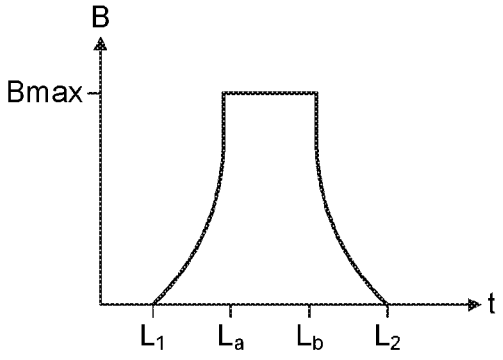

FIG. 12 shows a graph of a third example of a light signal, which again comprises a ramp-up period, a constant brightness period and a ramp-down period. In this case, the brightness increase in the ramp-up period and the brightness decrease in the ramp-down period are non-linear, and instead have a curved profile. As depicted the non-linear shape has an increasing slope, such as quadratic curve, or an exponential curve. Other non-linear shapes might be used, such as a curve with a decreasing slope, for example the first quarter of a sine wave (see FIG. 13). Any non-linear shape may be chosen, depending on the "fade-in" and "fade-out" visual effect desired for the brightening and dimming portions of the light signal.

Also, the FIG. 12 example shows that the ramp-up portion and the ramp-down portion are mirror images of one another, giving a symmetric brightness profile for the light signal. This is not essential, however, and a different profile may be used for the ramp-up portion as for the ramp-down portion. Similarly, a linear profile may be combined with a nonlinear profile.

Figure 13:
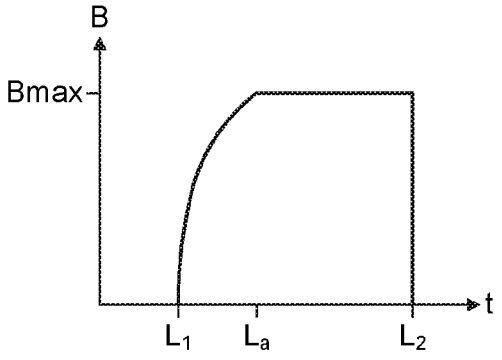

FIG. 13 shows a graph of a fourth example of a light signal, which includes only a ramp-up period from L1 to La, and a constant brightness period, which extends from La to L2 and hence ends at the end of the light signal duration TL. This arrangement gives a gradually increasing brightness at the start of the light signal, thereby saving power at a time when the user may not yet be able to see the indicator light clearly, and truncates the light signal sharply at its end, when the user may have ceased observation of the indicator light.

Other profiles for the light signal may alternatively be used; there is no limitation on the shape of the brightness profile. Other options include a constant brightness period followed by a ramp-down period, a ramp-up period only, and a ramp-down period only. The constant brightness period may be replaced wholly or partly with a period of varying brightness, such as pulsing or flashing. Alternative profiles are not precluded, however.

In any light signal profile, there will be a maximum brightness level displayed in that signal, at which the user will be most easily able to perceive the light signal. In examples which include a pause period and/or a ramp-up period, the maximum brightness for the signal will be reached at some time after the end of puff period. This can described as a time to maximum brightness in that signal. A useful duration for this time is considered to be in the range of 0.5 seconds to 1.5 seconds, or more particularly in the range of 0.7 to 1.3 seconds or 0.8 to 1.2 seconds, for example about 1 second.

In a further embodiment, any of the previous examples may be combined with a configuration in which the light signal is emitted by the indicator light under the control of the controller in response to user actuation of a user actuable control on the device. This provides an "on-demand" provision of the battery level indicator light signal, so that the user can be informed about the remaining battery power without the need to puff on the system. In the case of a system which includes an air flow detector to enable activation of the heater for aerosol production, a user actuable control may be provided to enable other functions, which can include causing emission of the light signal. In the case of a system that includes a user actuable control to enable activation of the heater for aerosol production, a different actuation action may be required to cause an on-demand emission of the light signal than is used for heater activation, for example a rapid press-and-release of a button control as compared to a press-and-hold action for heater activation.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A device for an electronic aerosol provision system comprising:

a battery for providing electrical power to an aerosol generating component in the system;

an indicator light configured to emit a light signal for a signal period that indicates a level of electrical power available from the battery; and a controller configured to activate the indicator light to emit the light signal after detecting that a puff period on the system has been completed, in which the controller is configured to activate the indicator light to emit the light signal at the end of a pause period that commences when the puff period is detected as having been completed; wherein the controller is configured to activate the indicator light to emit the light signal only at the end of a pause period that commences when the puff period is detected as having been completed.

2. A device according to claim 1, further comprising a user actuable control configured to cause provision of power from the battery to the aerosol generating component when actuated, such that the puff period corresponds to a duration of the actuation, and the puff period is detected as having been completed when actuation ceases.

3. A device according to claim 1, in which the system comprises an air flow sensor configured to cause provision of power from the battery to the aerosol generating component when air flow is sensed, such that the puff period corresponds to a duration of sensed air flow, and the puff period is detected as having been completed when air flow ceases.

4. A device according to claim 1, in which the pause period is in the range of 0.3 seconds to 0.7 seconds.

5. A device according to claim 4, in which the pause period is substantially 0.5 seconds.

6. A device according to claim 1, in which the light signal is emitted for a signal period in the range of 1 second to 5 seconds.

7. A device according to claim 1, in which the light signal is emitted for a signal period that ends at a time in the range of 1 second to 5 seconds from the detection of completion of the puff period.

8. A device according to claim 1, in which the signal period comprises a ramp-up period during which a brightness of the indicator light is increased from zero to a maximum brightness for the light signal, followed by a constant brightness period during which the brightness of the indicator light is maintained at the maximum brightness for the light signal, followed by a ramp-down period during which a brightness of the indicator light is decreased from the maximum brightness for the light signal to zero.

9. A device according to claim 8, in which the ramp-up period, the constant brightness period and the ramp-down period have substantially the same duration.

10. A device according to claim 8, in which the ramp-up period, the constant brightness period and the ramp-down period each have a duration in the range of 0.3 seconds to 1.5 seconds.

11. A device according to claim 9, in which the ramp-up period, the constant brightness period and the ramp-down period each have a duration of substantially 0.5 seconds.

12. A device according to claim 1, in which the light signal is emitted at any of two or more colors, each color indicating a different level of electrical power available from the battery.

13. A device according to claim 2, in which the controller is additionally configured to activate the indicator light to emit the light signal in response to a predefined pattern of actuation of the user actuable control, the predefined pattern differing from the actuation that causes the provision of power from the battery to the aerosol generating component.

14. A device according to claim 1, in which the indicator light comprises a light emitting diode arranged to deliver light to a light emitter on a surface of the device.

15. A device according to claim 14, in which the light emitting diode comprises an element configured to generate red light, an element configured to generate blue light and an element configured to generate green light.

16. A device according to claim 14, in which the light emitter is located within or around a user actuable control on the device.

17. An electronic aerosol provision system comprising a device according to claim 1.

18. A device according to claim 1, wherein the controller is configured to initially activate the indicator light to emit the light signal at the end of a pause period that commences when the puff period is detected as having been completed.

* * * * *